United States Patent [19]

Baldwin et al.

[11] Patent Number: 4,842,003

[45] Date of Patent: Jun. 27, 1989

[54] EMERGENCY UMBRELLA

[75] Inventors: Blair F. Baldwin, New York, N.Y.; William C. Lamson, Huntington, Conn.

[73] Assignee: Bexel Corporation, New York, N.Y.

[21] Appl. No.: 126,207

[22] Filed: Nov. 27, 1987

[51] Int. Cl.[4] ..... A45B 13/00

[52] U.S. Cl. ..... 135/19.5; 135/33 C

[58] Field of Search ..... 135/19.5, 33 R, 25 R

[56] References Cited

U.S. PATENT DOCUMENTS

| | | | |
|---|---|---|---|
| 369,374 | 9/1887 | Vail | 135/25 R |
| 892,813 | 7/1908 | Dolles | 135/25 R |
| 3,765,433 | 10/1973 | Fujihashi | 135/19.5 |
| 4,456,023 | 6/1984 | Fujihashi | 135/25 R |
| 4,624,275 | 11/1986 | Baldwin | 135/33 R |

FOREIGN PATENT DOCUMENTS

| | | | |
|---|---|---|---|
| 1429394 | 1/1966 | France | 135/19.5 |

*Primary Examiner*—Henry E. Raduazo

*Attorney, Agent, or Firm*—Burgess, Ryan and Wayne

[57] ABSTRACT

An emergency umbrella includes a hollow, tubular handle; a hub formed of an inverted cup-like section slidably contained in the handle between an open position at the upper end of the handle and a stored position at the lower end of the handle, the hub also including a piston secured to the inverted cup-like section; a sleeve slidably mounted on the hub between an upper position and a lower position, the sleeve including a central section slidably mounted on the hub and radially directed strut locking sections hingedly connected to the central section; a plurality of struts connected to the strut locking sections, each strut movable between an upright position substantially parallel to the longitudinal axis of the handle and a radial position substantially radially outward from the longitudinal axis; and a web of flexible, water-resistant material connected to the struts, such that opening and closing of the struts is accomplished by a snap action of the handle, whereupon the sleeve slides on the piston of the hub.

17 Claims, 4 Drawing Sheets

EMERGENCY UMBRELLA

BACKGROUND OF THE INVENTION

This invention relates generally to umbrellas and, more particularly, is directed to an emergency umbrella in which the handle also functions as a carrying case.

Because of unpredictability in the weather, it would be desirable to always have an umbrella ready at hand in case of an emergency. However, the size and bulkiness of conventional umbrellas does not make this feasible. Although there are presently on the market conventional umbrellas sold, for example, under the trademark "Totes" which are compact and fit within a briefcase, such umbrellas are rather complex in construction and, therefore, expensive.

Disposable umbrellas of the type in which the handle also functions as a carrying case are disclosed, for example, in U.S. Pat. No. 4,624,275 to the same inventor herein. However, with this disposable umbrella, the canopy and struts must be physically removed through one end of the tubular handle and then attached at the opposite end thereof. This may be rather inconvenient and troublesome.

U.S. Pat. No. 2,700,390 discloses a disposable umbrella in which the handle is detachable from the main portion of the umbrella and serves as a carrying case therefor. With this umbrella, the struts or ribs are normally pivoted in a direction opposite that from a normally closing umbrella, that is, in a direction inverted from a conventional umbrella. In order to prevent the struts from inverting during normal use, it is necessary with such an umbrella to utilize cords or similar type elements to tie down the struts. Further, when the umbrella is contained within the handle, the struts and canopy are inverted first and then inserted into the handle, with the hub being used as a cap on top of the open end of the handle. In operation, the entire canopy, struts and cap must first be removed from the handle, then inverted so that the cap is used as a plug on top of the handle. The canopy and struts must then be pushed down to their operable position, with the struts then being tied down by cords to the handle. This umbrella is, therefore, relatively complicated and difficult to use.

U.S. Pat. No. 3,186,421 discloses a compact umbrella in which an insert block 3 is slidably movable within a handle between a first stored position and a second open position, with struts pivotally connected to the insert block. When the insert block is moved to the open position, the struts are opened by gravity and position themselves within respective receiving slots in the handle. It is the receiving slots that maintain the struts in their open position.

U.S. Pat. No. 4,084,600 discloses an umbrella in which the struts or ribs are pivotally secured to a hub which slides within the handle. In this patent, the struts or ribs are pivotally attached to the hub for movement to a completely inverted position when it is carried within the handle. However,a relatively complicated arrangement of a biased locking plate which biases the inner ends of the struts to maintain them in their open position is provided. This construction, however, is relatively complicated.

U.S. Pat. No. 2,439,752 also discloses an umbrella in which the struts and canopy are insertable within a handle. The struts and canopy are locked in place at the upper end of the handle by a coupling or fastening pin which passes through openings on opposite sides of the upper part of the tubular handle. However, to close the umbrella, the ribs are not pivotable downwardly into the handle, but only laterally in the plane of the umbrella in its open position and then removed from the handle and inserted therein for storage.

U.S. Pat. No. 4,456,023 discloses an umbrella which is storable within its carrying handle. However, there is no disclosure as to how the umbrella is opened and from the disclosure in the patent, it appears that such an umbrella has a relatively complicated linkage assembly similar to that of compact umbrellas sold under the trademark "Totes".

U.S. Pat. No. 2,747,592 discloses a collapsible umbrella which is also relatively complicated in construction and use.

French Pat. No. 1,429,394 discloses an umbrella having a ball which is slidable within a handle between the upper and lower positions. A canopy is secured by angled cords to the ball and is normally held with the ball in the handle. In use, when the ball is pulled out by an auxiliary cord, the canopy is forced out of the handle and is held in its open position by the angled cords secured to the central ball. In effect, the French patent is similar to the aforementioned U.S. Pat. No. 2,700,390 which requires cords to tie down the struts or canopy to prevent the umbrella from inverting.

U.S. Pat. No. 3,709,238 discloses an umbrella in which the hub which contains the umbrella struts connected thereto is slidable within the handle. During folding of the umbrella, the hub slides inwardly into the handle and the struts and canopy fold upwardly and follow the hub into the handle. An inwardly extending annular shoulder is provided for preventing escape of the hub from the handle. Radially extending flexible stays or struts support the canopy material in the extended open position. However, to maintain the canopy in its open position, extending cord members are connected between the struts and the hub and are, therefore, similar to the aforementioned U.S. Pat. No. 2,700,390 and French Pat. No. 1,429,394.

U.S. Pat. No. 3,177,883 discloses an umbrella which is relevant for its disclosure of living hinges to connect the struts to the hub. However, the struts and hub are not storable within the handle.

U.S. Pat. No. 284,495 discloses ribs of an umbrella or parasol having longitudinal slits on their outer sides and a boat-shaped cavities therein. See also U.S. Pat. No. 3,884,301.

U.S. Pat. No. 4,627,455 discloses an umbrella rib linkage system which is relatively complicated. However, this patent is relevant for its disclosure in that the ribs have rounded tips.

The following patents are less relevant than the above U.S. Pat. Nos. 1,345,067; 1,457,679; 1,484,367; 1,484,367; 1,547,538; 1,697,520; 1,858,960; 2,044,805; 2,051,750; 2,091,676; 2,994,333 and U.K. Pat. No. 9,087.

OBJECTS AND SUMMARY OF THE INVENTION

Accordingly, it is an object of the present invention to provide an umbrella which permits relatively easy opening and closing of the canopy by a snap action.

It is another object of the present invention to provide an umbrella having channelled or cored struts that enhance such snap action opening and closing of the umbrella.

It is still another object of the present invention to provide an umbrella having channelled or cored struts which add to the structural rigidity of the umbrella to prevent lateral and vertical movement thereof.

It is yet another object of the present invention to provide an umbrella having tapered struts that aid in maintaining the canopy in its bowed configuration.

It is a further object of the present invention to provide an umbrella in which the lower surfaces of the struts are rounded to enable easier sliding of the struts and canopy in the handle.

It is a still further oject of the present invention to provide an umbrella having a thin plastic membrane securing the struts together, and which permits folding of the struts about the hub and also aids in preventing lateral movement of the canopy and struts in use.

It is a yet further object of the present invention to provide an umbrella having beveled edges at the hinged ends of the struts so that the struts fit together near the hub to prevent lateral movement of the struts and canopy.

In accordance with an aspect of the present invention, an umbrella includes a hollow tubular handle having a longitudinal axis; a hub slidably contained in the handle between an open position and a stored position; a sleeve slidably mounted on the hub between an upper position and a lower position; a plurality of struts connected to the sleeve, each strut hingedly movable between an upright position substantially parallel to the longitudinal axis of the handle and a radial position substantially radially outward from the longitudinal axis; and a web of flexible, water-resistant material connected to the struts.

In addition, the struts are preferably formed in a tapered fashion and are cored or channeled to provide additional stability to the umbrella. The hinged ends of the strut locking sections are also beveled so that they fit together when the umbrella is in its opened position to also aid the lateral stability of the umbrella. In addition, a thin flexible membrane connects the connected ends of the strut locking sections and is in spaced relation from the hub to provide still additional stability to the struts.

The above and other objects, features and advantages of the present invention will become readily apparent from the following detailed description thereof, which is to be read in connection with the accompanying drawings.

DETAILED DESCRIPTION OF THE PREFERRED EMBODIMENTS

Figure 1:
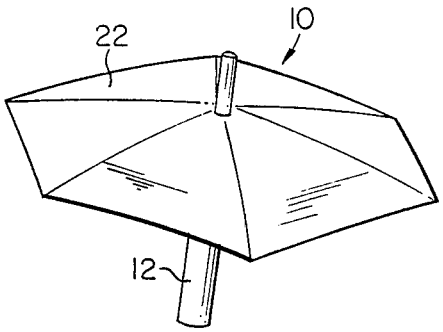
FIG. 1 is a perspective view showing the umbrella according to the present invention in its opened position.
Figure 2:
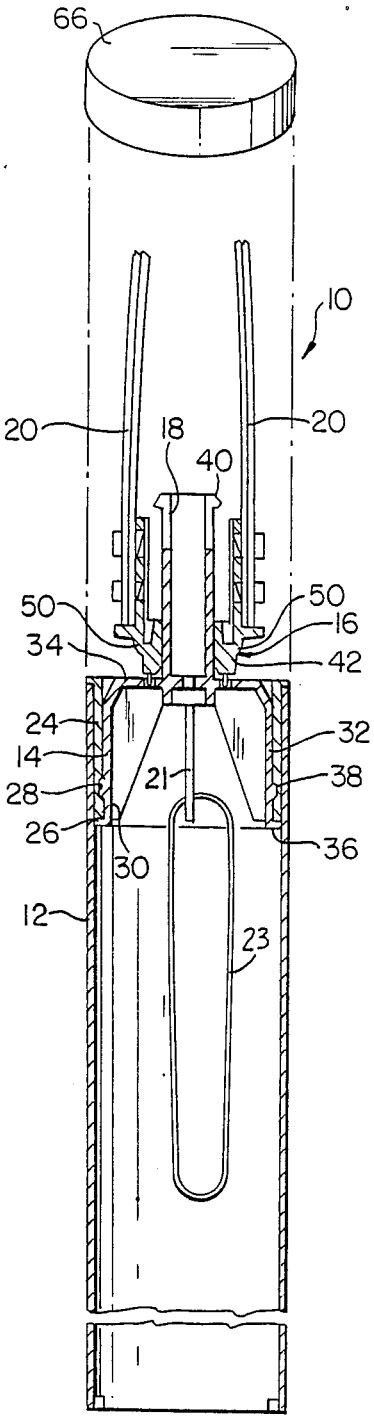
FIG. 2 is a cross-sectional view of the umbrella of FIG. 1 with the hub moved to its opened position and the struts in their upright positions ready to be opened.
Figure 3:
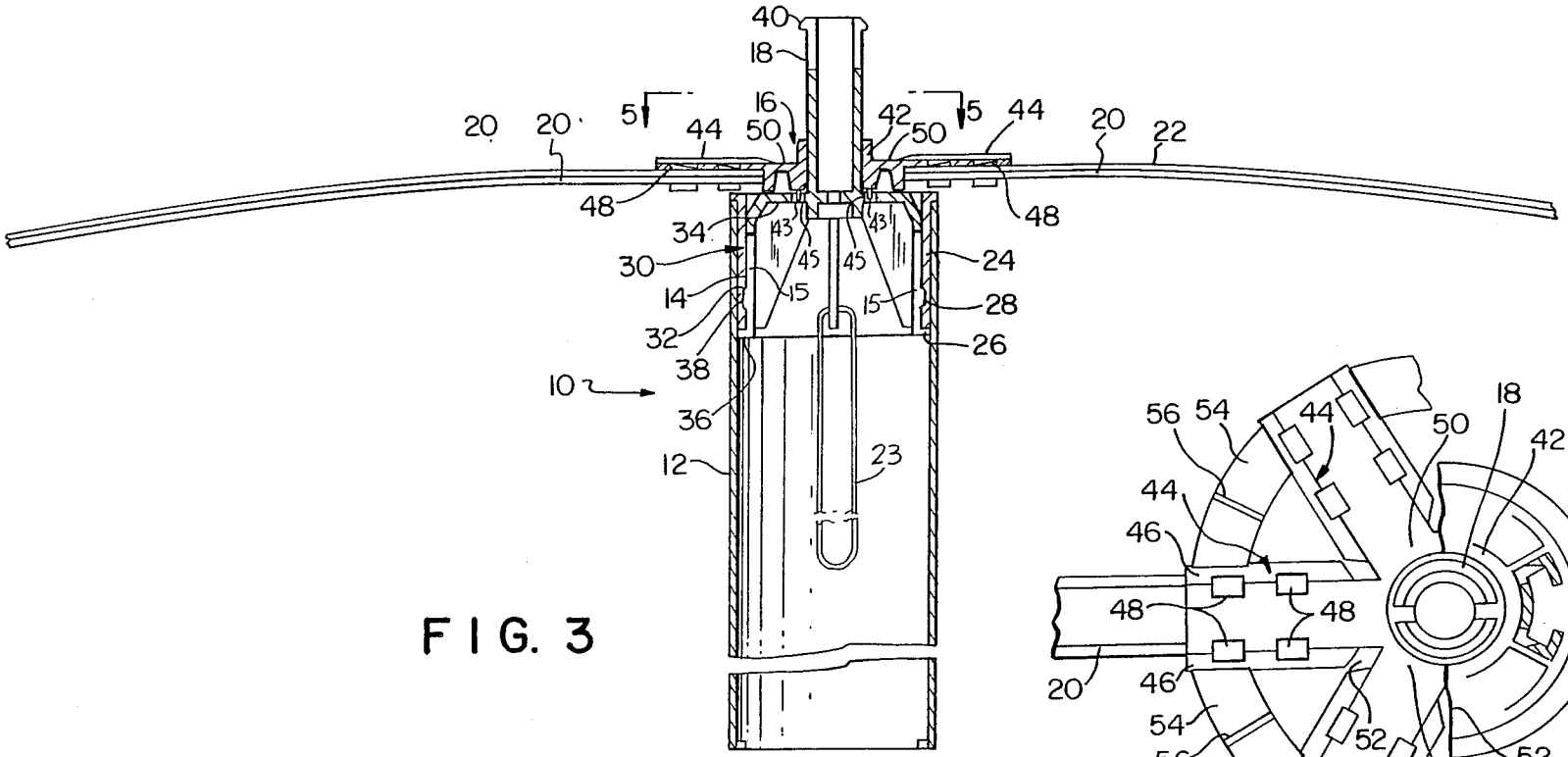
FIG. 3 is a cross-sectional view similar to FIG. 2, with the struts in their opened positions.
Figure 4:
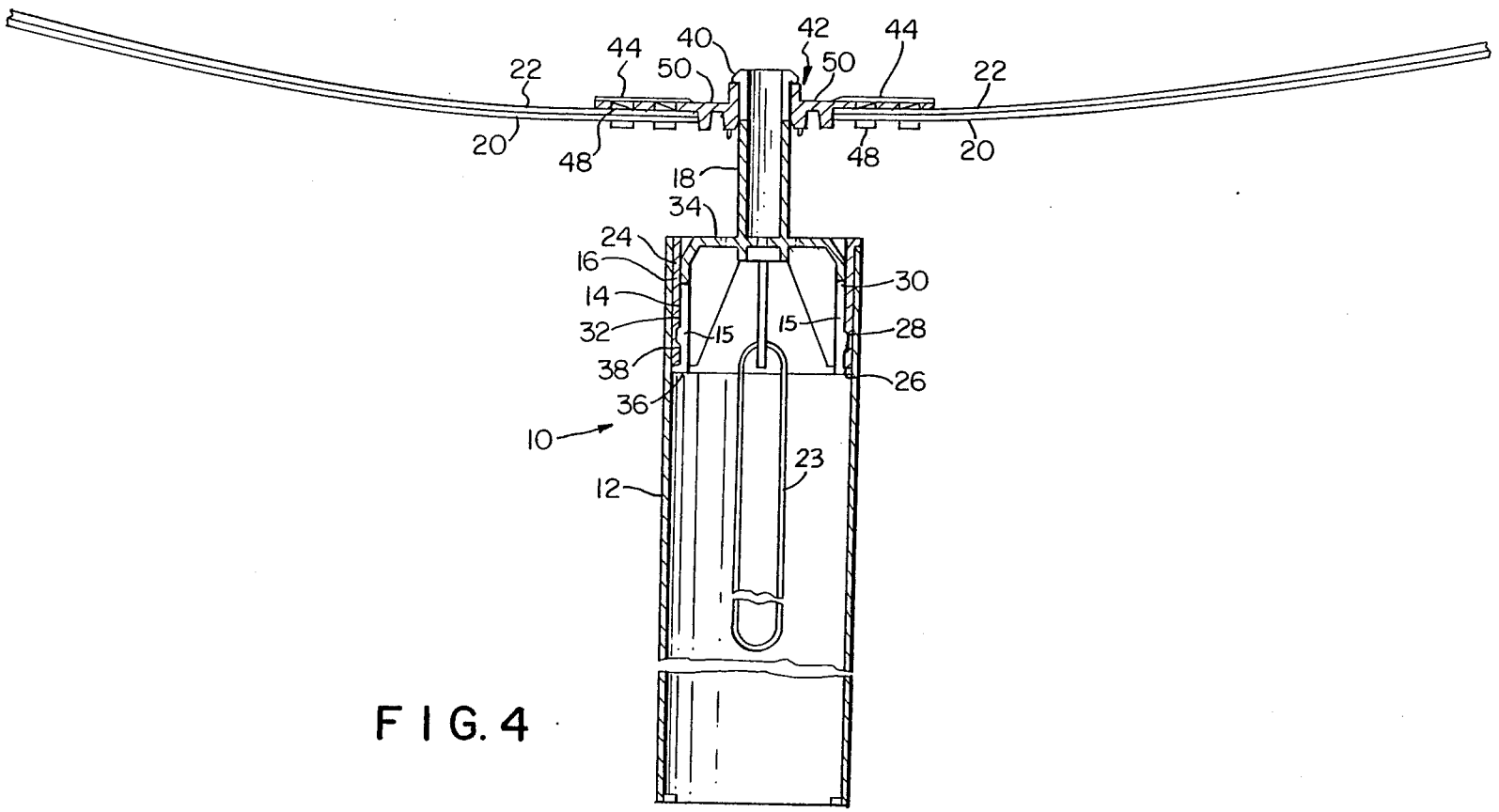
FIG. 4 is a cross-sectional view similar to FIG. 3, illustrating the operation for opening the struts from the position shown in FIG. 2 to that shown in FIG. 3.

Referring to the drawings in detail, and initially to FIGS. 1 and 2, an umbrella 10 according to the present invention generally includes a hollow tubular handle 12, a hub 14 slidable within handle 12 between a first open position shown in FIG. 2 and a second stored position at the lower end of handle 12, a sleeve 16 slidably mounted on an upper piston 18 of hub 14, a plurality of struts 20 hingedly connected to sleeve 16 and hingedly movable between the vertical storage configuration shown in FIG. 2 and an open radial configuration shown in FIGS. 3 and 4, and a one-piece, continuous web or canopy 22 of flexible, water-resistant material connected to struts 20. Although canopy 22 is shown in a hexagonal configuration, the present invention is not limited to this configuration.

Specifically, as shown in FIG. 2, a locking sleeve 24 is secured at the upper end of handle 12, thereby defining a limiting shoulder 26 at the lower end surface thereof. Locking sleeve 24 also includes an inner circumferential groove 28 near the lower end thereof.

Hub 14 includes an inverted cup-like section 30 having a thin annular wall 32 closed by an upper wall 34. An outwardly directed radial flange 36 is formed at the lower edge of annular wall 32 and cooperates with limiting shoulder 26 of locking sleeve 24 to prevent escape of cup-like section 30 of hub 14 from the upper end of handle 12. In addition, an annular detent 38 is formed on the outer surface of annular wall 32 so as to mate with inner circumferential groove 28 of locking sleeve 24 when radial flange 36 abuts against limiting shoulder 26. Accordingly, as shown in FIG. 2, hub 14 can be locked in the upper open position of the umbrella. In this regard, a plurality of slits 15 are formed in cup-like section 30 to permit the same to deform and thereby releasably engage within sleeve 24.

A central post 21 extends centrally within hub 14 and is secured to the underside of upper wall 34. A strap 23 is secured to the lower end of post 21. When the umbrella is in its stored position, that is, when the struts are positioned within handle 12 so that hub 14 is at the lower end of handle 12, strap 23 extends out of handle 12 and can be used to carry umbrella 10. When umbrella 10 is opened so that hub 14 is at the upper end of handle 12 in FIG. 1, strap 23 is disposed within handle 12.

Upper piston 18 is connected in a vertically extending arrangement from upper wall 34 of cup-like section 30 of hub 14 and has a limiting flange 40 extending radially outward therefrom at the upper end thereof.

As aforementioned, sleeve 16 is slidably positioned on piston 18 and movable between the upper position shown in FIG. 4 and the lower position shown in FIG. 2. Generally, sleeve 16 is formed as a spider element with a central section 42 which is slidable on piston 18 and radially extending strut locking sections 44, hingedly conncected to central section 42. In order to prevent rotation of sleeve 16 on piston 18 when umbrella 10 is opened, as shown in FIG. 3, the underside of central section 42 includes a plurality of downwardly extending projections 43 which engage within holes 45 in upper wall 34 of hub 14. Alternatively, or in addition, a keyway slot, teeth or the like can be formed between cup-like section 30 of hub 14 and sleeve 24, such as between groove 28 and detent 38, between shoulder 26 and flange 36, or the like. Each strut locking section 44 is formed by opposing U-shaped channel elements 46 having locking tabs 48 secured thereto. The individual struts 20 are positioned within strut locking sections 44 and, in particular, between U-shaped channel elements 46 and releasably secured therein by locking tabs 48 that extend through respective grooves or channels in struts 20.

In accordance with an important aspect of the present invention, the hinged ends of U-shaped elements 46 are connected by a living or other hinge 50 so as to be movable between the upright position shown in FIG. 2 and the radially extended position shown in FIGS. 3 and 4. In order to increase lateral stability of the umbrella, the connected ends of U-shaped elements 46 adjacent living hinges 50 are beveled, as at 52, such that beveled edges 52 of adjacent strut locking sections 44 abut, or substantially abut, each other, to increase lateral stability thereof.

Figure 5:
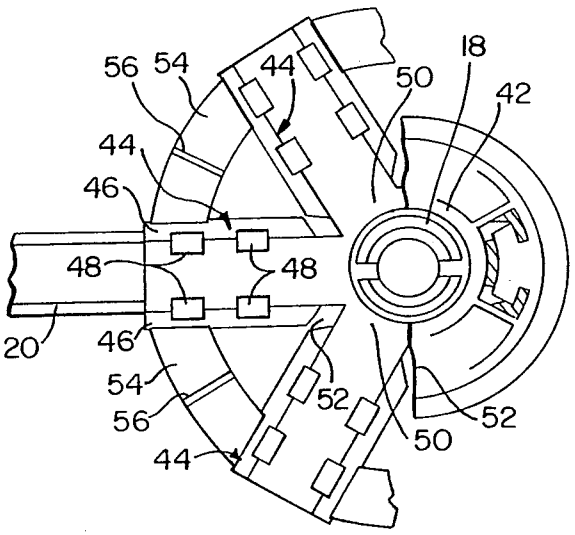
FIG. 5 is a cross-sectional view of the umbrella of FIG. 3, taken along line 5—5 thereof.

In addition, as shown in FIG. 5, a thin flexible annular membrane 54 connects the distal or free ends of strut locking sections 44 to further increase lateral stability of the umbrella in its open position. In order to permit movement of strut locking sections 44 to the position shown in FIG. 2, flexible membrane 54 is formed with a plurality of living hinges 56 substantially centrally between each pair of adjacent strut locking sections 44.

Figure 7:
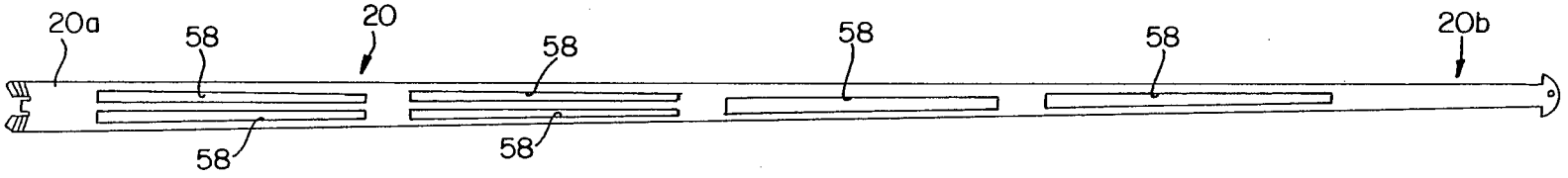
FIG. 7 is a top plan view of one strut that can be used with the present invention.

Referring now to FIG. 7, each strut 20 is preferably made of polypropylene and has a tapered configuration, tapering from proximal end 20*a* thereof to distal or free end 20*b* thereof. Proximal end 20*a* is connected with strut locking sections 44. As a result, such configuration aids in moving the umbrella from its closed position of FIG. 2 to the open position of FIG. 3 and aids in maintaining the canopy and struts in their bowed configuration. The reason for this is that because of the reduced dimensions at the distal end 20*b;* struts 20 are more flexible at their tips which aids in maintaining the bowed configuration.

In addition, as shown in FIG. 7, grooves or slots 58 are provided longitudinally of each strut 20 so as to provide a channelled or cored strut. Such channelling or coring of struts 20 aids in preventing side to side bowing and other movements and adds to the structural rigidity of struts 20 and, therefore, of umbrella 10 in the opened position. The coring of struts 20 need not be in the form of the lengthwise channels shown, but may take any other suitable configuration, such as circular holes or recesses, a honeycomb cored configuration or the like, or any combination thereof, in the struts. Also, the coring may be in the form of recessed sections or through holes.

Struts 20 may also be molded in a bent, downwardly bowed configuration, such as shown in FIG. 3, in an unbiased state, so as to maintain the canopy in a bowed configuration when opened. The struts 20 will then be forced into a straight configuration when pushed into handle 12.

Figure 8:
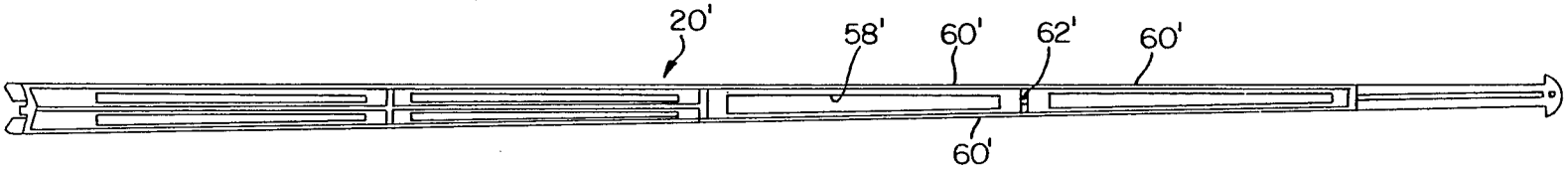
FIG. 8 is a top plan view of another strut that can be used with the present invention.

FIG. 8 shows a slight modification of a strut 20′ in which the grooves or slots 58′ are formed in a slightly different manner and the outer portion of strut 20′ is also recessed, as shown at 60′, and is further recessed between grooves or slots 58′ as shown at 62′.

Figure 6:
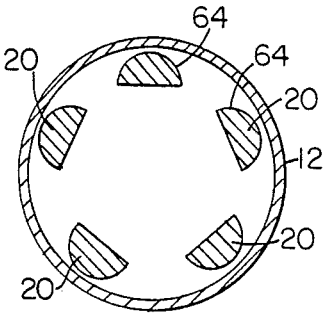
FIG. 6 is a cross-sectional view of the umbrella of FIG. 1, with the struts in their stored position within the handle.

In addition, the underside of each strut 20 and 20′ is rounded, in cross-section, at the lower or bottom surface 64 thereof to permit struts 20 and 20′ to slide more readily within handle 12 when moved between the stored and opened positions, as shown in FIG. 6.

In operation, hub 14 is normally stored, along with struts 20 and web 22 within handle 12. In such case, although not shown, hub 14 is moved to the lower end of handle 12, as viewed in FIG. 2, so that struts 20 and web 22, in the position shown in FIG. 2, slide within handle 12 and are stored therein. In such case, a cap 66 can be provided for covering the upper open end of handle 12. When it is desired to open umbrella 10, cap 66 is removed and can be placed at the lower end of handle 12. However, it is preferable that no cap 66 be provided. Specifically, when in the stored position, umbrella 10 is carried by strap 23 so that handle 12 is reversed, with the upper end thereof in FIG. 1, disposed as the lower end. Accordingly, when no cap 66 is provided, water can drain out of the open end of the carried umbrella 10.

Struts 20, web 22 and hub 14 are then pulled upwardly to the position shown in FIG. 2. This may be accomplished by pulling on struts 20, or alternatively, a separate cord (not shown) may be provided which is attached to hub 14 for pulling the same upwardly, in a manner similar to that of French Pat. No. 1,429,394. When hub 14 is pulled to its upward limiting position, as shown in FIG. 2, it is releasably locked thereat by means of annular detent 38 engaging within inner circumferential groove 28. Then, handle 12 is moved rapidly in the upward direction and snapped down quickly. As a result of such snapping action, sleeve 16 slides upwardly on piston 18 to the position shown in FIG. 4 and when sleeve 16 abuts against limiting flange 40, struts 20 are forced radially outward, as shown in FIG. 4 and maintained in the desired bowed configuration. The engagement of Annular detent 38 with groove 28 prevent hub 14 from falling back into handle 12 during this motion. Then, sleeve 16 with struts 20 extending radially outward falls down by gravity to the position shown in FIG. 3, whereby umbrella 10 is maintained in its opened position by reason of the configuration of struts 20, as aforementioned. Specifically, because of the configuration of struts 20 and the lateral stability applied by strut locking sections 44, umbrella 10 is maintained in its opened position shown in FIG. 3.

In order to close and store umbrella 10, handle 12 is again moved rapidly upwardly and then snapped down. This results in sleeve 16 again moving upwardly and abutting against limiting flange 40 of piston 18, whereby struts 20 are snapped into their upright position shown in FIG. 2. Then, sleeve 16 falls down to the position shown in FIG. 2, with struts 20 remaining upright. Thereafter, hub 14, struts 20 and web 22 are pushed downwardly into handle 12, and cap 66 is placed over the open upper end of handle 12.

It will be appreciated that if a sudden gust of wind moves struts 20 from the open position of FIG. 3 to the position of FIG. 2, the struts 20 can be moved down into handle 12, or alternatively, the user can impart the aforementioned snap action again to open the umbrella. There is no need for the user to touch the wet canopy or struts to move them to their open positions, as with conventional umbrellas.

In addition, with conventional umbrellas, the hexagonal canopy is formed from six substantially triangular shaped sections which are sewn together at their side edges. The side edges of the triangular shaped sections are generally convex because a substantial tensioning force is provided on the side edges at the center of the seem due to the supporting struts, that is, additional canopy material is required at the center of each side edge of each panel to take into account the large tensioning forces thereat. The center of each side edge has the largest force applied thereto in such conventional umbrellas. This is the basis by which prior art umbrellas achieve their bowed configuration. The support struts extend from a lower portion of the handle and engage the main struts at a position substantially midway of the convex edges of the canopy panels. As a result, the maximum tensile strength occurs substantially midway of the side edges of the sewn panels of the canopy. This provides a substantial force to the canopy which tends to separate the panels thereof from each other, which causes failure of the umbrella over a short period of time.

With the present invention, on the other hand, because of the arrangement of the struts, there is no need to provide any further strengthening or support struts as with conventional umbrellas. Further, the canopy is made of a continuous web material, not of the aforementioned side panels, since the bowing effect is a result of the struts. As a result thereof, the maximum tensile strength with the present invention occurs closer to the center of the umbrella where the struts are wider and thereby provides a stronger umbrella.

It will, therefore, be obvious that the present invention provides a novel arrangement which is relatively simple and economical to manufacture and use. By reason of the sliding arrangement on piston 18, opening and closing of the umbrella becomes relatively simple by a mere snap action by the user. In addition, the formation of struts 20 and sleeve 16 provides increased stability for the umbrella in its opened position.

Having described specific preferred embodiments of the invention with reference to the accompanying drawings, it will be appreciated that the present invention is not limited to those precise embodiments, and that various changes and modifacations can be effected therein by one of ordinary skill in the art, without departing from the spirit or scope of the invention, as defined by the appended claims.

What is claimed is:

1. An umbrella comprising:

a hollow tubular handle having a longitudinal axis;

a hub slidably contained in said handle between an upper position and a stored position;

a sleeve slidably mounted on said hub between an upper position and a lower position, said sleeve resting on said hub when said umbrella is in a fully opened position and said hub is in said upper position and when said hub is in said stored position;

a plurality of struts connected to said sleeve, each strut hingedly movable between an upright position substantially parallel to the longitudinal axis of said handle and a radial position substantially radially outward from said longitudinal axis; and a web of flexible, water-resistant material connected to said struts.

2. An umbrella according to claim 1, wherein said hollow tubular handle includes first locking means at an upper end thereof and said hub includes second locking means for engaging with said first locking means to releasably lock said hub at the upper end of said hollow tubular handle at said opened position.

3. An umbrella according to claim 2, wherein said first locking means includes one of a groove and detent at the upper end of said handle and said second locking means includes the other of a groove and detent on said hub.

4. An umbrella according to claim 1, wherein said hub includes an inverted cup-like section slidable within said hollow tubular handle and a piston mounted on said inverted cup-like section.

5. An umbrella according to claim 4, wherein said inverted cup-like section includes an annular detent and said hollow tubular handle includes an inner circumferential groove for engagement with said annular detent for locking the hub in said opened position.

6. An umbrella according to claim 4, wherein said sleeve is slidable mounted on said piston between said upper position and said lower position.

7. An umbrella according to claim 6, wherein said piston includes upper limiting means for limiting upward movement of said sleeve thereon.

8. An umbrella according to claim 1, wherein each strut includes a connected proximal end and a free distal end, and said struts each have a width which tapers from said proximal end to said distal end thereof.

9. An umbrella according to claim 1, wherein each strut is cored.

10. An umbrella according to claim 1, wherein lower surfaces of said struts are rounded.

11. An umbrella according to claim 1, wherein said struts have a bent, downwardly bowed configuration in an inbiased state.

12. An umbrella according to claim 1, further including anti-rotation means for preventing rotation of said sleeve on said hub so as to prevent rotation of said web.

13. An umbrella comprising:

a hollow tubular handle having a longitudinal axis;

a hub slidably contained in said handle between an upper position and a stored position;

a sleeve slidably mounted on said hub between an upper position and a lower position, said sleeve including a central section slidably mounted on said hub and strut locking sections radially extending from said central section;

a plurality of struts connected to said sleeve, each strut hingedly movable between an upright position substantially parallel to the longitudinal axis of said handle and a radial position substantially radially outward from said longitudinal axis, each strut having an inner end secured to a strut locking section; and a web of flexible, water-resistant material connected to said struts and having the same shape as the struts in the fully opened position.

14. An umbrella according to claim 13, wherein each strut locking section includes channel means for receiving a respective strut and at least one locking means for locking said respective strut in said channel.

15. An umbrella according to claim 13, wherein each strut locking section is hingedly connected to said central section by a living hinge so as to permit movement of the respective strut attached thereto between said upright position and said radial position.

16. An umbrella according to claim 13, wherein each strut locking section has a free end, and further comprising annular membrane means for securing free ends of adjacent strut locking sections, said membrane means including hinge means between adjacent strut locking sections for permitting movement thereof between said upright position and said radial position.

17. An umbrella comprising:

a hollow tubular handle having a longitudinal axis;

a hub slidably contained in said handle between an upper position and a stored position;

a sleeve slidably mounted on said hub between an upper position and a lower position;

a plurality of struts connected to said sleeve, each strut hingedly movable between an upright position substantially parallel to the longitudinal axis of said handle and a radial position substantially radially outward from said longitudinal axis;

a web of flexible, water-resistant material connected to said struts;

said sleeve including a central section slidably mounted on said hub and strut locking sections radially extending from said central section, and each strut locking section being adapted to secure a strut thereto each strut locking section including a free end and a hinged end, and edges of said strut locking section adjacent said hinged end are beveled so as to at least substantially abut each other to provide lateral stability for said strut locking sections.

* * * * *